US007802770B2

(12) United States Patent
Field, Jr.

(10) Patent No.: US 7,802,770 B2
(45) Date of Patent: Sep. 28, 2010

(54) MECHANICAL CLIMBING AID OF THE CAM TYPE

(75) Inventor: John E. Field, Jr., Dorrington, CA (US)

(73) Assignee: Metolius Mountain Products, Inc., Bend, OR (US)

( * ) Notice: Subject to any disclaimer, the term of this patent is extended or adjusted under 35 U.S.C. 154(b) by 0 days.

(21) Appl. No.: 12/767,355

(22) Filed: Apr. 26, 2010

(65) Prior Publication Data

US 2010/0207002 A1 Aug. 19, 2010

Related U.S. Application Data

(63) Continuation of application No. 12/361,966, filed on Jan. 29, 2009, now Pat. No. 7,740,223, which is a continuation of application No. 10/917,027, filed on Aug. 11, 2004, now abandoned.

(60) Provisional application No. 60/494,354, filed on Aug. 12, 2003.

(51) Int. Cl.
*F16M 11/00* (2006.01)

(52) U.S. Cl. ..... 248/694; 248/274.1; 248/925

(58) Field of Classification Search ..... 248/694, 248/925, 231.9, 274.1; 482/37; 294/94, 294/95, 96; 424/195.15; 81/486
See application file for complete search history.

(56) References Cited

U.S. PATENT DOCUMENTS

| | | | | |
|---|---|---|---|---|
| 4,184,657 | A * | 1/1980 | Jardine | 248/231.9 |
| 4,513,641 | A * | 4/1985 | Murray et al. | 81/486 |
| 4,643,377 | A | 2/1987 | Christianson | |
| 4,645,149 | A * | 2/1987 | Lowe | 248/231.9 |
| 4,781,346 | A | 11/1988 | Banner | |
| 4,832,289 | A | 5/1989 | Waggoner | |
| 5,860,629 | A * | 1/1999 | Reed | 248/231.9 |
| 6,042,069 | A | 3/2000 | Christianson | |
| 6,375,139 | B1 | 4/2002 | Murray et al. | |
| 6,679,466 | B2 * | 1/2004 | Brown | 248/231.9 |
| 6,736,359 | B2 | 5/2004 | Murray | |
| 7,014,156 | B2 * | 3/2006 | Apezetxea et al. | 248/231.9 |
| 7,040,588 | B2 * | 5/2006 | Lowe | 248/231.9 |
| 7,740,223 | B2 * | 6/2010 | Field, Jr. | 248/694 |
| 2002/0162927 | A1 * | 11/2002 | Brown | 248/231.9 |
| 2005/0037023 | A1 * | 2/2005 | Field | 424/195.15 |
| 2005/0218282 | A1 * | 10/2005 | Phillips | 248/231.9 |

* cited by examiner

*Primary Examiner*—Terrell Mckinnon
*Assistant Examiner*—Todd M. Epps
(74) *Attorney, Agent, or Firm*—Hancock Hughey LLP

(57) ABSTRACT

A climbing cam having opposed asymmetrically sized cam members to eliminate the interference that limits the expansion range of climbing aids of the cam type. An optional cam member provides an opposing force to assist in maintaining the placement of the cam in the rock.

20 Claims, 9 Drawing Sheets

MECHANICAL CLIMBING AID OF THE CAM TYPE

FIELD OF THE INVENTION

This invention relates to climbing aids particularly though not necessarily exclusively to climbing aids of the cam type for rock climbing and the like.

BACKGROUND

A wide variety of climbing aids are used to secure individual or groups of climbers to the rock or mountain that they climb. By attaching a rope to one or more climbing aids affixed to the rock and having the rope attached to the climber or climbers, it is possible to limit the distance over which a climber can fall. Since the terrain is frequently difficult to ascend, a fall is not necessarily an unlikely occurrence and the climbing aid provides for a margin of safety which otherwise would not exist.

Climbing aids come in many forms, and most aids may generally be classified as being either active devices or passive devices. Passive devices typically do not include any mechanical or moving parts that assist in attachment of the device to the rock, and instead rely upon friction and gravitational forces to achieve anchoring. Active devices on the other hand generally include some kind of mechanical parts that assist in anchoring the protection on the rock wall.

The simplest form of a passive device is a climbing nut or chock, which typically is simply a piece of metal with a wire or rope loop to attach to it. The piece of metal may be placed snugly into a crack or imperfection in the rock and then attached to the aforementioned rope. Such climbing aids have the significant disadvantage of being unable to adjust to different size cracks and will only work if the rock is of a matching shape for the particular climbing aid.

To improve upon this problem, passive climbing aids of this sort have been geometrically shaped to provide for the possibility of a maximum number of possible fortuitous placements. Some can be placed in three or more possible orientations to increase the chances that a secure (and therefore safe) placement may be found.

In many cases, however, a crack in the rock has nearly smooth sides and there are no features to which such a climbing aid could safely attach. Active climbing aids such as those known as "cams" are useful protection for this type of rock formation, and there are numerous cam devices on the market, and many different mechanisms to operate them. These devices are often referred to as "cams" because they consist of metal pieces in the shape of a logarithmic spiral, "cam members," free to rotate on one or more axles but directed by springs or other mechanisms so as to expand to fill all the space in a crack. In the event that a force is applied to this type of climbing aid (as in the case of a fall or a load applied to the climbing aid), the physics of the logarithmic spiral provides for a tightening action due to force multiplication on the rock which prevents the device from sliding free of the crack.

To provide some general background information, a climbing cam typically includes one or more pairs of opposed cam members that typically have eccentric outer surfaces. The cam members are pivotally mounted one or more transverse shafts or axles in a way that allows opposed cams to pivot in opposite directions. The cams are spring-loaded and are activated with a trigger. When the trigger is pulled, the cams rotate from their open, extended position toward a closed or compressed position. The compressed cam is then inserted into a crack in a rock, and the trigger is released. When the trigger is released the cam members rotate under the force of the springs back toward their open position until the opposed cams contact the rock.

Assuming that the correct sized cam has been chosen for the crack in question, the cam members engage opposite sides of the crack to provide a frictional engagement with the rock, thereby providing an anchoring point. The cam typically includes a loop or sling of cable attached to it. A carabiner is typically attached to the cable and a loop of webbing is attached to the carabiner. Another carabiner is then connected to the opposite end of the webbing and the rope is passed through the second carabiner. This system allows the rope to move freely through the carabiners without unduly moving the cam and risking it's coming loose. Outwardly directed loads applied to the cam—as when a climber's fall is arrested—causes the cam members jam against the rock as described above.

The variety of sizes that may be accommodated by a climbing aid of the cam type I s often measured in terms of the "expansion range." The expansion range may be described in various ways, but is typically defined as being numerically equal to the ratio of the largest to the smallest size crack to which the climbing aid may be applied safely. It is well known that for a climbing aid of the cam type with a single axle, the expansion range is limited by interference between the cam members and opposite sides of the crack. This limits the expansion range to about 1.62 for a cam angle of 13.25 degrees. Cams are available in numerous sizes, ranging from very large units having a safe expansion range of up to 4 inches or more, to very small units that have a safe expansion range of less than ½ inch. The safe expansion range of a cam, however, is somewhat less than the actual maximum range of the device.

The particular cam selected by the climber depends on several factors, including for example the topography of the crack into which the cam will be inserted, and the width of the crack. Selection of the correct sized cam and proper placement of the cam is obviously very important since improper sizing and placement can lead to failure of the protection when it is most needed.

Since it is usually the case that the climber does not know exactly what features will appear on the rock, it is necessary to carry several and sometimes many climbing aids of all sorts in order to accommodate all the possibilities which may be required. This increases the weight, bulk, and expense of equipment that is required. There is a need to increase the possibilities for placements of the climbing aids while at the same time decreasing weight. It will be appreciated therefore that it is beneficial to maximize the workable expansion range, as a cam that has a larger expansion range may be used in a wider variety of crack sizes.

U.S. Pat. No. 4,643,377 describes a climbing aid of the cam type in which two parallel axles are employed in order to increase the expansion range. With the appropriate arrangement, it is possible to use slightly larger cam units than on a single axle device and this results in an increase in the overall expansion range to about 1.68. This requires additional weight and mechanical complexity for the device, but these devices have become popular as a consequence of the increase in expansion range.

There is a need therefore for improved climbing cams that have increased working ranges.

Additionally, because a climbing cam is typically not loaded except in a fall or when direct aid from the device is required, due to motion of the climber and the rope, it is possible for the climbing aid to move or rattle around in the crack so as to fall out of the crack, move from the optimal position, or otherwise degrade the placement. This unintentional relative movement between the cam and the rock is often called "walking." While stiffer springs in the climbing aid may help to alleviate this problem, it would require a large force of perhaps 100 pounds or more to hold the climbing aid in position. At this level, it is not feasible to add springs stiff enough to generate the outward force. There is a need for a mechanism capable of lock the climbing aid in place to prevent it from moving, or to minimize movement of the cam after it is placed.

BRIEF DESCRIPTION OF THE DRAWINGS

The invention will be better understood and its numerous objects and advantages will be apparent by reference to the following detailed description of the invention when taken in conjunction with the following drawings, in which like numerals represent like members.

DETAILED DESCRIPTION OF THE PREFERRED EMBODIMENTS

Figure 1:
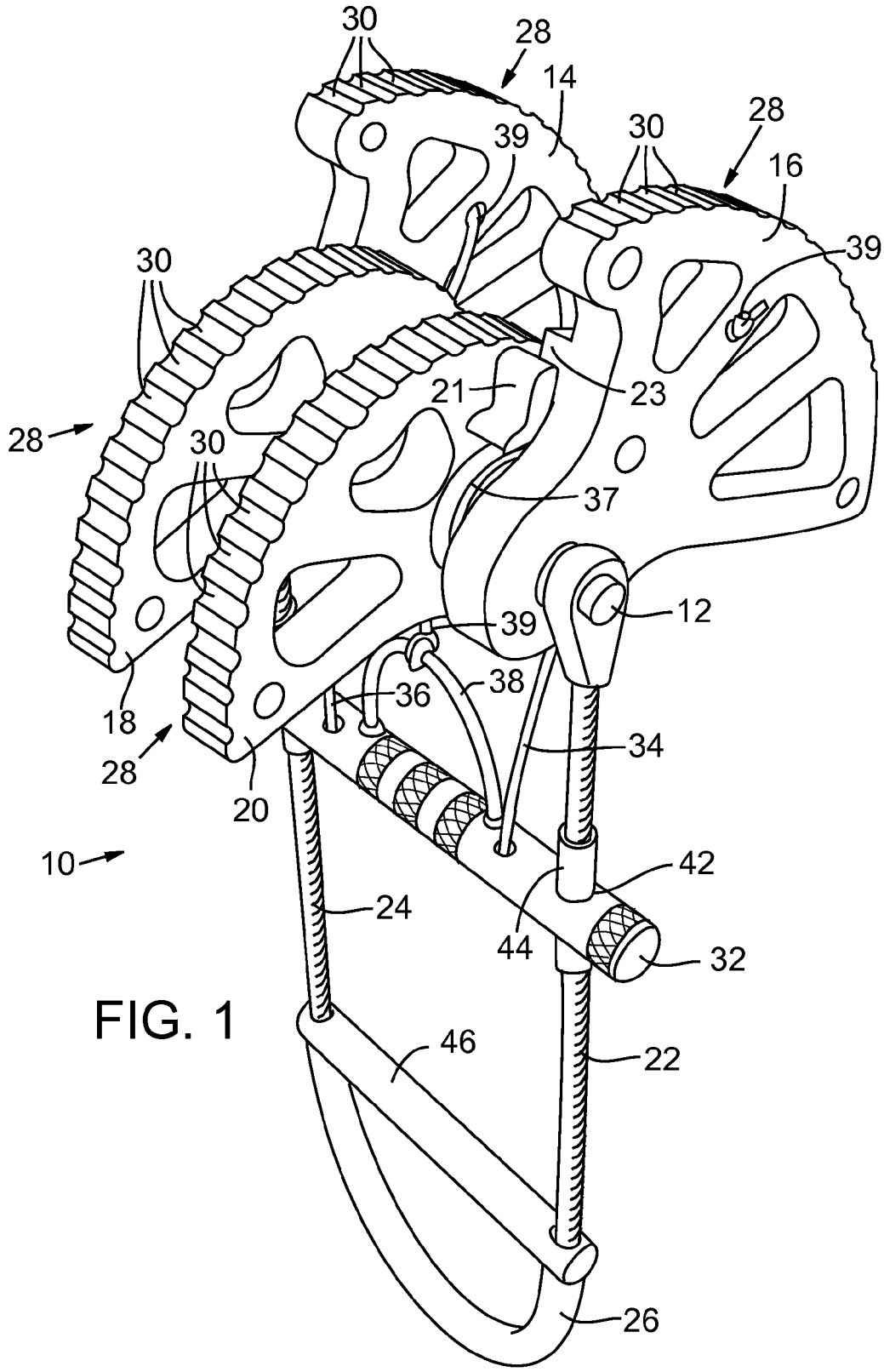
FIG. 1 is perspective view of a climbing cam incorporating cam members and mechanisms according to the present invention.

This invention relates to a climbing aid of the "cam" type of improved design, which increases the probability of a safe placement opportunity while at the same time reduces weight and increases security of the placement. It will be appreciated by one accustomed to the art of climbing that a "cam" type climbing aid which could be used over a greater variety of sizes would allow the climber to carry and purchase less equipment and would be a substantial improvement over prior art.

The present invention furnishes a group of analytical techniques for designing climbing aids of the cam type so as to increase the variety of sizes that a single climbing aid may accommodate while at the same time increasing placement security.

In accordance with one aspect of the invention, a climbing aid of the cam type is constructed in which the cam members are unequal in size and chosen in size so as to eliminate or reduce the aforementioned interference problem that limits the expansion range of the climbing aid.

In accordance with another aspect of the present invention, a climbing aid of the cam type is constructed in which the cam members are of unequal in size and configuration so as to significantly reduce the distance between one side of the crack and the axle of the climbing aid. This has the advantage of increasing the axial strength of the climbing aid and thereby increases security of the placement.

In accordance with yet another aspect of the present invention, a climbing aid of the cam type is constructed in which a loop of wire or other tethering material is wound around a feature on at least one of the cam members so as to cause it to rotate by more than 180 degrees when the trigger is actuated.

In accordance with yet another aspect of the present invention, a climbing aid of the cam type is constructed that includes a limitation on the relative rotation between adjacent cam members that limits their rotation over a range that may exceed 360 degrees.

In accordance with yet another aspect of the present invention, an additional cam member—usually a fifth cam member—is included in the climbing aid. This cam member has at least several degrees more cam angle than that of the other cam members and the cam angle is oriented in the opposite fashion from the other cam members so as to create an counteracting or counter-opposing force preventing motion of the climbing aid either in or out, or alternately up or down in the crack.

In accordance with yet another aspect of the present invention, the additional cam member may be provided with a triggering action due to a cable, wire, or string which is wrapped approximately half a turn around the back side (side not touching the rock) of said cam member. This cable is also attached to a trigger mechanism operated by the climber's fingers.

As background information, the logarithmic spiral that describes a cam member is a family of mathematical curves that are parameterized by a tangent angle referred to herein as the "cam angle." The "cam angle" is important in the design of climbing aids of the cam type because it controls the force multiplication effect of the device as described below. Too much cam angle, and the climbing aid may slip due to inadequate sliding friction coefficient; too little cam angle, and the climbing aid or the rock may mechanically fail due to increased force multiplication. The "cam angle" is often chosen to be somewhere between 12 and 15 degrees in order to achieve the optimum balance of friction and strength over a variety of rock and placement conditions. Normally there is a trade-off between frictional gripping effects and expansion range of the climbing aid.

A cam member can be functionally described by its cam angle, which is the angle of the logarithmic spiral, as well as the subtended angle which is the total angle subtended looking from the axle point over which frictional contact with the rock may be achieved in the normal usage of the climbing aid. As will be described below, it is sometimes the case that a cam member has a varying cam angle as defined by the local average of the tangent angle of the logarithmic spiral. In this case, it is still possible to talk about the cam member in terms of approximate cam angle and total subtended angle as before.

With reference now to FIG. 1, a cam device 10 according to the present invention includes 4 individual cams members, labeled 14, 16, 18 and 20, each of which is mounted for rotation on an axle 12 that has opposite ends mounted to the respective end portions of opposite upright arms 22, 24 of a U-shaped member 26. U-shaped member 26 is typically fabricated from wire cable.

In the embodiment illustrated in FIGS. 1 through 4, cam members 14 and 16 are positioned on axle 12 outwardly and on opposite sides of cam members 18 and 20. Each cam member has an eccentrically curved outer surface 28 that is defined by the logarithmic spiral described above. In the illustrated embodiment outer surface 28 includes a plurality of grooves 30 to increase the holding strength of the device when placed in a crack. Cam members 14 and 16 are shaped identically with respect to their curved outer surfaces 28, and are relatively larger than cam members 18 and 20, which also are shaped identically in respect of their curved outer surfaces 28.

Each cam member is connected to a trigger or activation bar 32 by a wire, which may be metal wire, wire cable, cord, or any other suitable material. Thus, wire 34 attaches to cam member 16 and wire 36 attaches to cam member 14. Cam members 18 and 20 are connected to trigger 32 by a common wire 38, which as shown in FIG. 1 defines a loop with its opposite ends connected to trigger 32 and a single wire 39 connected to the cam members 18 and 20 in the manner detailed below. One end of each wire described above is connected to the respective cam member, and the opposite end is attached to the activation bar. Activation bar 32 is slidably mounted on U-shaped member 26. Specifically, activation bar 32 has bores near its outer ends, only one of which is shown in FIG. 1 and labeled 42, through which opposite upright arms 22, 24 respectively pass. In the illustrated embodiment, a sleeve 44 such as plastic or nylon is placed in bore 42 to assist smooth sliding of the trigger on the upright arms as the trigger is activated. This manner of connecting the cam members to the activation bar allows the cams to be activated (i.e., pivotally rotated about the mounting axle 12) by sliding the activation bar reciprocally along the upright arms 22, 24.

Figure 2:
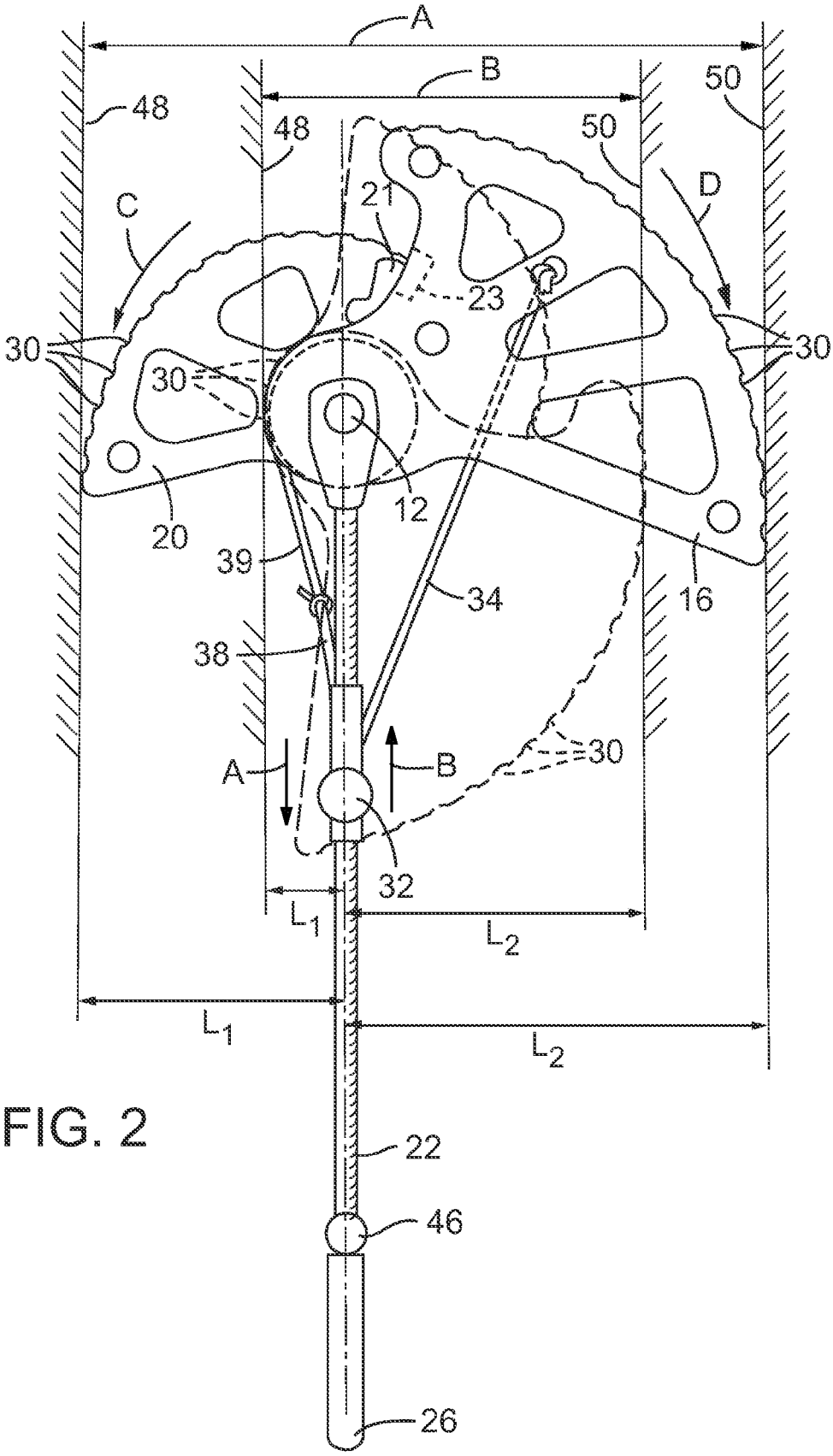
FIG. 2 is a side elevation view of the cam shown in FIG. 1, showing the cam positioned in a crack in a rock in a first position in solid lines, and showing in dashed lines the same cam moved into a second position in which the cam is positioned in a relatively narrower crack in a rock.
Figure 3:
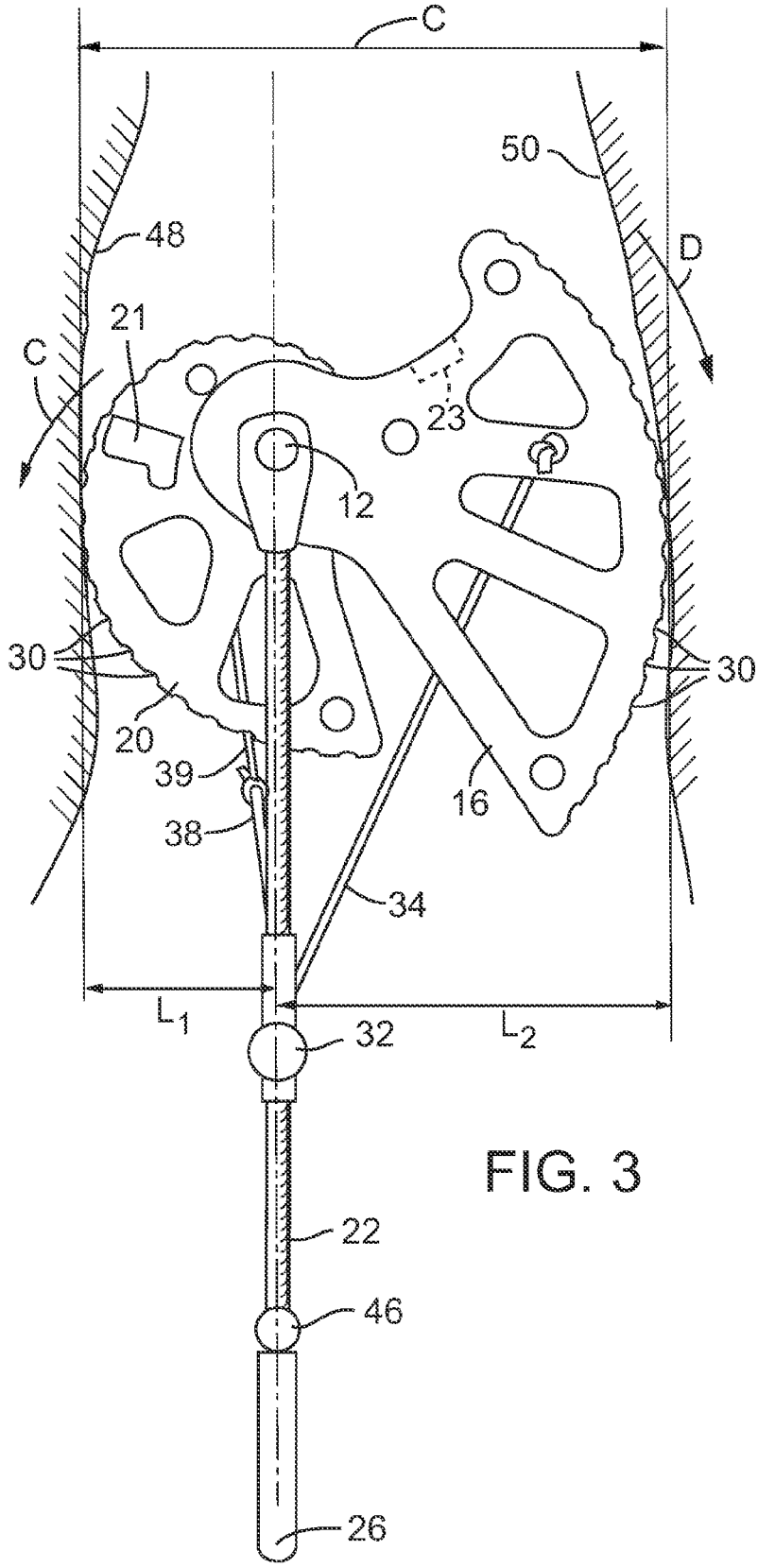
FIG. 3 is a side elevation view of the cam shown in FIG. 1, illustrating the cam in positioned in a crack in a rock.
Figure 4:
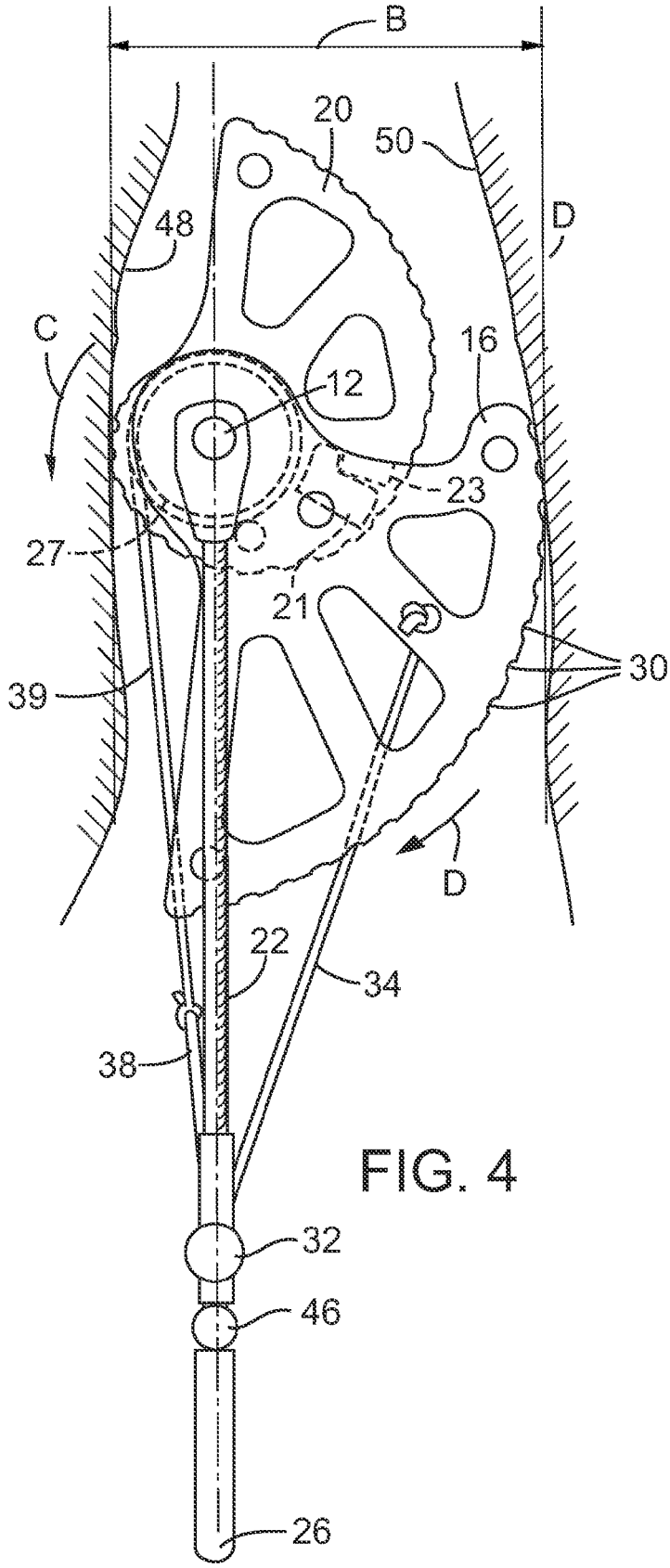
FIG. 4 is a side elevation view of the cam shown in FIG. 3 in which the cam members have been compressed further relative to the positions shown in FIG. 3, allowing the cam to be positioned in a relatively narrower crack.

The cam device 10 includes springs such as spring 37, which is partially visible in FIG. 1, spirally wound about the axle and having one end attached to the cam member 16 and the opposite end attached to adjacent cam member 20. Typically there is one spring for each pair of cam members. The springs such as spring 37 are preferably flat, spiral wound clock-type springs that urge the cam members into the position shown in FIG. 1, which is the expanded, resting and open position in which cam device 10 has the maximum range. It will be appreciated that there are numerous ways in which the cam members may be driven with springs in the same manner described herein. With reference to FIG. 2, the range of cam device 10 is represented by the difference between dimension A, which represents the span of the cam between the outermost points on opposed cam members 16 and 20 when the cam is in the expanded position, and dimension B, which represents the span of the cam between the outermost points on opposed cam members 16 and 20 when the cam is in the fully retracted position. The position of the cam members shown in FIG. 1, which as noted is the resting position, is referred to as the "first", "open" or "expanded" position. On the other hand, the position of the cam members shown in FIG. 4 is referred to as a second position in which the cam members are fully "retracted" or "closed"—this is the position in which width of the cam (defined by dimension B) is the narrowest. In FIG. 3 the cam members are shown in an intermediate position between the open and closed positions of FIGS. 1 and 4, and defined in FIG. 3 by dimension C.

Each cam member 14, 16, 18 and 20 is mounted on axle 12 for independent rotation about the axle. The two outermost cam members 14 and 16 move generally in unison when activation bar 32 is moved, and the two innermost cam members 18 and 20 likewise move in unison. This is due to the manner in which wires 34, 36, 38 and 39 connect trigger 32 to the respective cam members. With reference to FIG. 2, as activation bar 32 is moved in the direction of arrow A, cam members 18 and 20 rotate in a counterclockwise direction (illustrated with arc C). Cam members 14 and 16 rotate simultaneously in the clockwise direction (illustrated with arc D). As noted, the springs such as spring 37 that are wound around the axle and connect to the cam members urge the cam members into the open position. As such, when activation bar 32 is moved in direction A, the cam members rotate against the counter acting force of the springs and some measure of force on trigger 32 is necessary to overcome the force applied by the springs. When activation bar 32 is moved in the direction opposite arrow A (i.e., in the direction of arrow B), cam members 18 and 20 rotate clockwise under spring force toward the first position, and cam members 14 and 16 rotate counterclockwise under spring force toward the first position. Each cam member 14, 16, 18 and 20 includes optional stop tabs facing the next adjacent cam members so that the cam members stop in the first position. With reference to FIG. 1, a stop tab 21 is shown on cam member 20, and a stop tab 23 is shown on cam member 16. When the cam 10 is in the resting position, it may be seen that stop tab 21 abuts stop tab 23 to stop rotation of the cam members 20 and 16. The cam members are held in this position under the force of the springs. Like stop tabs are used on cam members 14 and 18 although not visible in the drawings.

A spreader bar 46 is typically attached to the upright arms 22, 24 to maintain the U shape in U-shaped member 26.

Figure 1A:
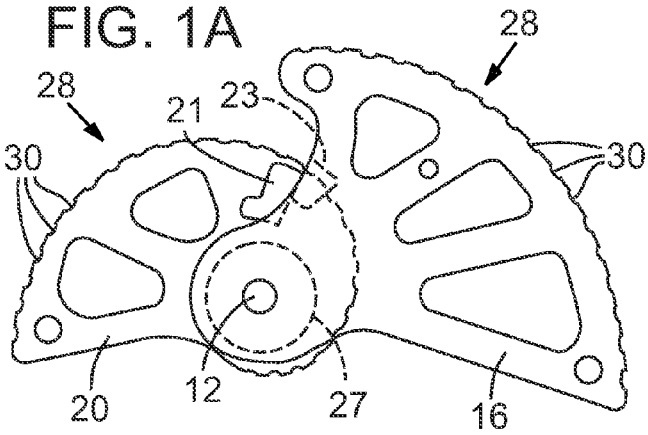
FIG. 1A is a side elevation view of two opposed cam members of the type used in the cam illustrated in FIG. 1, showing the two opposed cam members in isolation in their "open" or "expanded" position.

Asymmetry of cam member size is used in the present invention to eliminate the interference that limits the expansion range of climbing aids of the cam type. The asymmetry also reduces the distance between the axle and at least one side of the rock crack thereby increasing axial stiffness and placement security. Referring now to FIG. 1A, two opposed cam members 16 and 20 are shown in isolation without the other structural members of cam 10, but in the relative positions that the cam members would be in when the cam 10 is in the open position shown in FIG. 1. It may be seen that in this position, the two stop tabs 21 and 23 abut one another to thereby stop relative rotation of the cam members 20 and 16. That is, spring 37 normally urges cam member 20 in the clockwise direction in FIG. 1A, and cam member 16 in the counterclockwise direction. The rotation of the two cam members is stopped when the tabs 21 and 23 abut one another.

Cam 16 is larger than cam 20 and has a different shape. As detailed below, this asymmetry of cam member size and shape provides for more placement options and greater working range for cam 10.

Figure 1B:
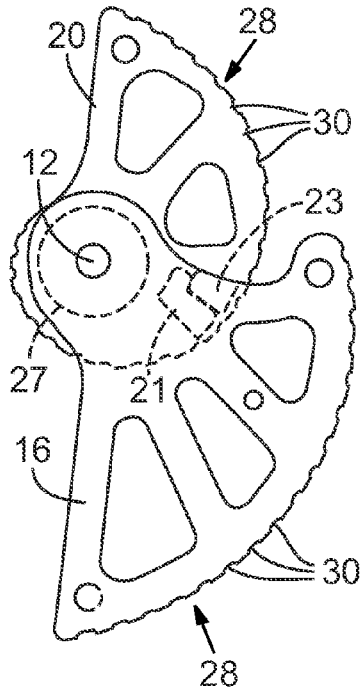
FIG. 1B is a side elevation view of the two opposed cam members shown in FIG. 1A, illustrating the cam members in their fully "closed" or "retracted" position.
Figure 1C:
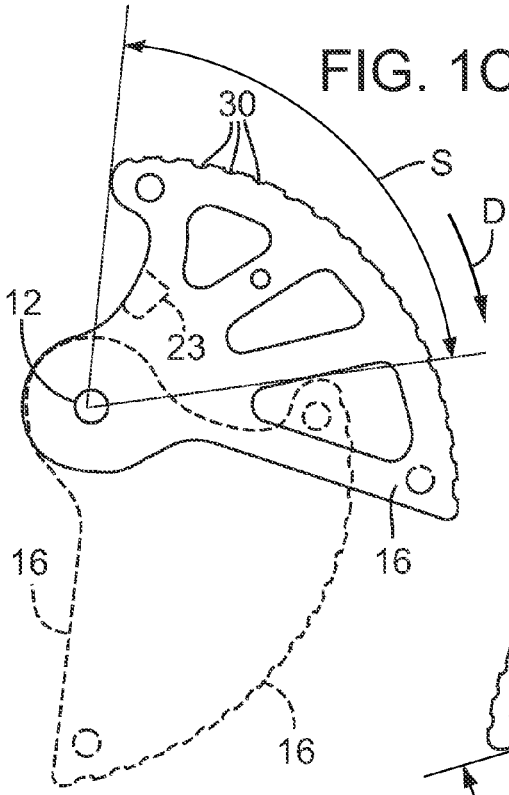
FIG. 1C is a side elevation view of the larger of the two cam members shown in FIG. 1A and illustrating the full angle of rotation of the cam member when it is incorporated into the cam of FIG. 1.
Figure 1D:
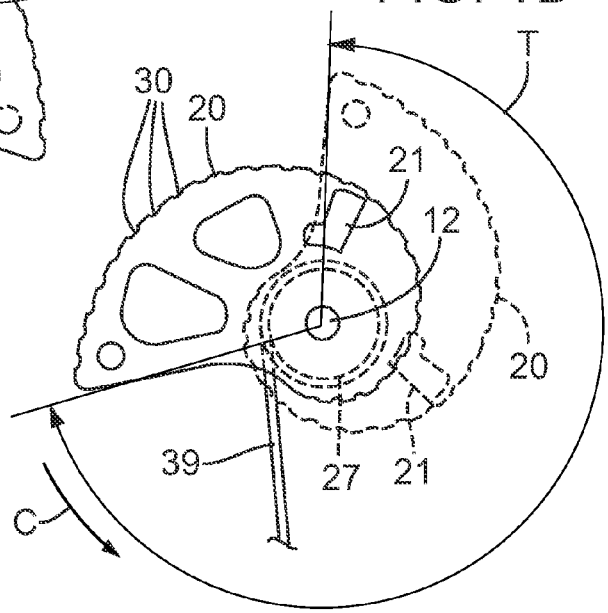
FIG. 1D a side elevation view similar to the view of FIG. 1C but showing the smaller of the two cam members shown in FIG. 1A and illustrating the full angle of rotation of the cam member when it is incorporated into the cam of FIG. 1.

Turning to FIGS. 1C and 1D, the rotational characteristics of cam members 16 and 20 are detailed. In FIG. 1C it may be seen that cam member 16 is capable of rotation on axle 12 through an angle of approximately at least 60°, and within a range of about 60° to about 95°. The angle of rotation of cam member 16 is shown by angle S. More preferably, the angle of rotation of cam member 16 is between about 75° to about 85°. Thus, when cam member 16 is activated by sliding trigger 32, cam member 16 rotates in the clockwise direction (the direction of arc D in FIG. 1C) through a rotational angle of about 75° to about 85°. The degree of rotation of cam member 16 is determined by the position at which wire 34 is connected to cam member 16, and the position of stop tab 23.

In FIG. 1D it may be seen that cam member 20 mounted for rotation on axle 12 through an angle of approximately about 240° to about 260°, as shown by angle T. Thus, when cam member 20 is activated by sliding trigger 32, the cam member rotates in the counterclockwise direction (the direction of arc C in FIG. 1D) through a rotational angle of about 240° to about 260°. The degree of rotation of cam member 20 is determined by the position at which wire 39 is connected to cam member 20, and the position of stop tab 21. It will be appreciated that in order to facilitate this degree of rotation of cam member 20, wire 39 must be wrapped around at least a portion of the cam member, and this is shown in FIG. 1D as spindle 27, around which wire 39 is wrapped. The angle of rotation through which cam member 20 rotates is dictated by the distance around spindle 27 that wire 39 is wrapped, and other factors such as the length of travel of trigger 32. While a rotational angle of between about 240° to about 260° is preferred for cam member 20, the rotational angle may be adjusted according to the needs of the situation, but will in all cases be greater than 200°. In FIG. 1D wire 39 is shown as being wrapped completely around spindle 27, that is, 360° around the spindle.

Based on the foregoing, while there is a variable range of relative rotation through which the two cam members 16 and 20 are capable of rotating, the relative rotation between the two is at least about 275°.

Turning now to FIG. 1B, the two cam members 16 and 20 are shown in the fully retracted or closed position—that is, the position in which the cam 10 is at the narrowest. In this position, cam member 16 has rotated in the clockwise direction through an angle of about 75° measured from the resting position, and cam member 20 has rotated in the counterclockwise direction through an angle of about 250° measured from the resting position. It may be seen that tabs 21 and 23 stop relative rotation of the two cam members 16 and 20. The relative combined rotation of the two cam members 16 and 20 is thus about 325°.

It will be appreciated that the stop tabs (e.g., 21 and 23) are convenient for adjusting the relative rotational positions of the cam members, but that rotation may be adjusted in similar ways, for example by adjusting the position and length of the wires 34, 36, 38, 39, and the distance along which trigger 32 is capable of sliding on arms 22, 24.

FIGS. 2, 3 and 4 illustrate schematically cam 10 shown positioned such that two opposed cams members 20 and 16 are in contact with the surfaces 48 and 50 of a series of cracks in a rock. If the cam device 10 was of the correct size for the crack in the rock, the cam will seat securely in the crack with opposed cam members urged outwardly against the rock by the force applied by the springs (e.g., spring 37). The climber is able to secure a rope through a carabiner and/or other aids connected to the cam member, and when a cam is correctly positioned, outwardly directed load (as occurs when a fall is arrested by the climbing rope) causes the cam members to be urged with substantial force against the rock surfaces 48 and 50 to arrest the fall. With reference to FIG. 2, the cam members 20 and 16 shown in solid lines are shown wedged in a wide crack (dimension A), and the cam members 20 and 16 shown in phantom lines are shown wedged in a relatively narrow crack (dimension B). To place the cam 10 in the crack, the trigger 32 is moved in the direction of arrow A, thereby simultaneously moving cam member 20 in the counterclockwise direction (illustrated with arc C) and cam member 16 in the clockwise direction (as shown by arc D), until the width of the cam 10 measured between the outermost edges of opposed cam members 20 and 16 is narrower than the width of the crack. The cam 10 is then placed into the crack, and the trigger 32 is released so that the trigger moves in the direction of arrow B. Cam member 20 thus rotates in the clockwise direction and cam member 16 rotates counterclockwise until the outer surfaces 28 of the cam members engage the respect rock surfaces 48 and 50 and the cam 10 seats in the crack. By reference to FIG. 2, it will be appreciated that the rotationally leading tip of cam 20 as the cams rotate relative to one another is at all times throughout the rotation of the cams within the outer perimeter defined by the outer surface 28 of cam 16. This allows the two cams to rotate relative to one another at least 275°. Stated another way, the rotationally leading tip of cam 20 is able to rotate in a crack past cam 16 without contacting rock surface 50. As the relatively larger cam member 16 rotates, the point on the outer surface 28 that defines the maximum radius moves through a path or perimeter. Likewise, as the relatively smaller cam member 20 rotates, the point on the outer surface of that cam member that defines the maximum radius moves through a path. In the preferred embodiment, the path through which the point defining the largest radius on cam member 20 moves is within the path that the point defining the largest radius on cam member 16 moves—that is, the paths do not intersect. It is possible within the scope of the present invention to set the maximum radius of the smaller cam member 20 so that is at or slightly outside the perimeter defined by the larger cam member, but this tends to introduce the possibility for interference between the smaller cam member and the rock surface.

In FIG. 3 cam 10 is shown seated in a crack having a width dimension C between surfaces 48 and 50 of the rock. This is representative of a crack having a width intermediate between the width of dimension A and dimension B of FIG. 2.

In FIG. 4 cam 10 is shown seated in a crack having a width dimension B between surfaces 48 and 50 of the rock. This is representative of a crack having the same width as dimension B of FIG. 2, and illustrates the narrowest crack that that the cam 10 will fit into. In FIG. 4, cam 20 is rotated fully, about 250°, in the counterclockwise direction from the resting position, and cam 20 is rotated nearly fully, about 75°, in the clockwise direction from the resting position.

It will be apparent that the nominal position of the axle 12 when cam 10 is placed in a crack is closer to one side of the crack than the other. In contrast, with either a single or twin axle type of cams according the prior art, the nominal position of the axle is equidistant between the two sides of the crack. The offset or off-center position of axle 12 when cam 10 is placed in a crack is shown by dimensions $L_1$ and $L_2$ in FIGS. 2 and 3. In these figures, dimension $L_1$ is the distance between the axial center of axle 12 and the point where cam member 20 touches surface 48 of the crack, and $L_2$ is the distance between the axial center of axle 12 and the point where cam member 16 touches surface 50 on the other side of the crack. It will be appreciated that regardless of the width of the crack, $L_1 < L_2$.

Under load, a climbing aid of the cam type has a tendency to mechanically fail when the forces of the load and the reaction forces of the rock combine so as to create an axially directed force at the axle. It is the stiffness of the rotating joint between the axle or axles and the cam members that determines the resistance of the climbing aid to failure in this manner.

Assuming that there are a total of four cam members, two of each size, defining $L_1$ and $L_2$ as the distances from the axle to the opposite rock faces, and assuming that the reaction torque due to a rotation by an angle perpendicular to the axle is equal to k times the angle, we can evaluate the reaction force on the axle in response to an axial displacement dx as:

$$F=dx*k*(2/L_1+2/L_2).$$

This equation actually has a minimum when $L_1+L_2$ are equal to the width of the crack, and reaches infinity as either $L_1$ or $L_2$ goes to zero. Consequently, the stiffness increases as the asymmetry between $L_1$ and $L_2$ increases. This can be thought of in terms of the familiar fact that to bend or break a rod that is supported at both ends, it is much easier to push in the middle rather than near the ends. The result is that the cam 10 shown in the drawings is stiffer and stronger in the asymmetric configuration—and becomes more so with increasing asymmetry.

This is especially useful for the case of very large cams in which axle failure in the axial direction becomes the dominant failure mechanism. By making the cam members unequal in size, increases in the stiffness of the order of three times can be generated greatly reducing the chance of failure and therefore increasing the safety—a greatly desirable feature. Additionally, for a given level of strength, less material is required and therefore weight may be reduced.

A substantial additional advantage in the expansion range of the climbing aid if the ratio of the sizes of the cam members is chosen to be within a certain range. By making the cam members unequal in size, it is possible to eliminate the interference that occurs in a normal climbing aid of the cam type. When the ratio between the size of the large cam (e.g., cam member 16) and the small cam (e.g., cam member 20) is sufficient, it is possible for the smaller cam member 20 to continue to rotate around within the crack without the tip touching the opposite side of the crack. It is therefore possible to accommodate a crack size for which a symmetric, or nearly symmetric climbing aid of the cam type would not be able to contract to accommodate.

The optimal condition may depend on the conditions of the rock and the strength of the materials used in the device and other factors, but it is possible to mathematically describe the conditions required to maximize the expansion range for the idealized case of a crack with perfectly parallel sides and a particular chosen cam angle, a. In this case, the geometry of the climbing aid can be described by the simultaneous solution to the following equations:

$$A*\exp(pa*\tan(a))=B*\cos(a)$$

$$B*\exp(pb*\tan(a))*\cos(pb+a)=-A*\cos(a)$$

$$B*\cos(pa+a)=A$$

$$A_{max}=A*\exp(pa*\tan(a))$$

$$B_{max}=B*\exp(pa*\tan(a))$$

Where

A=smallest radius of small cam

B=smallest radius of large cam

Pa=angle subtended by small cam

Pb=angle subtended by large cam

A=cam angle

Logarithmic spiral profile:

RA(theta)=A*exp(theta*tan(a))

RB(theta)=B*exp(theta*tan(a))

$A_{max}$=largest radius of small cam $B_{max}$=largest radius of large cam

The following table shows the solution for these equations for cam angles often used by climbing aid manufacturers:

| Cam Angle | B/A | $B_{max}/A_{max}$ | Pa (degrees) | Pb (degrees) | Expansion Range |
|---|---|---|---|---|---|
| 13.25 | 3.18 | 1.47 | 275.1 | 87.8 | 1.83 |
| 13.75 | 3.32 | 1.5 | 273.8 | 87.5 | 1.86 |
| 14.00 | 3.38 | 1.51 | 273.2 | 87.3 | 1.88 |

As mentioned before, there are a variety of reasons why it may be desirable to deviate from the calculated values above. For example, although it is not useful in a perfectly parallel crack, the addition of material on the large cam at the small end of the angle subtended increases the available range in a shallow or flaring crack because the interference created by the tip of the large cam may not occur or may occur at a greater contraction. Furthermore, since the perfectly smooth parallel crack is an idealization, deviations from the ratio may be desirable to take into account clearance even in the presence of finite roughness or a taper in the crack. Limitations of the mechanism may also play a role. For example, it may be desired to design the trigger 32 to limit the total angular travel to less than a certain number of degrees, as in the case of fixed rotation stops on the climbing aid. Even in the case of floating rotation stops described below, it may be desirable to limit the rotation to a certain value for mechanical reasons. As a practical matter, it is desirable to use round corners on the cam members and this too causes small deviations from the optimal ratio at the point of interference. As described above, for additional axial strength, additional deviations from symmetry may be desirable. In very rough cracks, additional range can be obtained by reducing the asymmetry somewhat, although interference that limits utility becomes increasingly likely in this case. One skilled in the art will appreciate all of these effects and others as reasons to deviate possibly significantly from these calculated values depending on the device and the conditions of its expected use. For example, deviations in the ratios enumerated above have little or no effect on the invention as claimed herein. More specifically, the ratio of $B_{max}$ to $A_{max}$ may be as low as 1.4. It will be appreciated that these deviations are included in the spirit of the present invention.

It will be apparent that position of the relatively large cam members such as cam members 14 and 16 in FIG. 1 may be interchanged with the position of the relatively smaller cam members 18 and 20 without changing the principles of the present invention. Stated another way, cam members 18 and 20 may be moved outwardly to the positions of cam members 14 and 16 in FIG. 1, and vice versa.

It may be desirable to have a variable cam angle and thereby deviate from the logarithmic spiral slightly. The logarithmic spiral is optimal for the case of cracks with scale invariant shape and near the middle of the expansion range of the cam. Because the cam 10 cannot expand and contract indefinitely and the roughness and strength of the rock (as well as the material of the climbing aid) varies at different length scales, it may be desirable to vary the effective cam angle slightly versus angle on the cam members so as to compensate for this effect. For example, climbing aids in which the cam angle gradually increases from 13.25 degrees to 16.5 degrees over the subtended angle so as to reduce loading at the cam member tips and prevent over-expansion of the climbing aid may be made. In this case, the cam angle is strictly defined only by a local average and the optimal size ratios will deviate from the calculated values, yet the desirable result of elimination of the interference can still be readily achieved with asymmetries comparable to those calculated.

The present invention is structurally configured so that the cam members are able to rotate collectively through a greater angle than on a climbing aid of the cam type according to the prior art. A further embodiment of the present invention is defined by the configuration of the spindle 27 (see FIG. 1D), around which wire 39 is wound to facilitate the extra rotation of the cams. The small cam members 18 and 20 are fitted with a substantially round spindle 27 as shown in FIG. 1D. The spindle 27 may in cross sectional shape be round as shown, or a fraction of a circle, or in the lobe shape of a cam, or a part thereof. It will be appreciated that other shapes may be used which accomplish the same effect within the spirit of the present invention. Wire 39 is wound around the spindle 27 a desired and predetermined distance so as to cause a rotation of the smaller cam members 18 and 20 through a desired rotational angle when the trigger 32 is actuated. In order to even the force of the springs (such as spring 37) or for other reasons, it may be desirable to use a spindle shape other than round so as to vary the mechanical advantage against the trigger during operation. In any case, the wire 39 is wound around the spindle and is attached thereto in a desired position. As shown in FIG. 1, the opposite end of wire 39 is connected to trigger 32, in this case with the looped wire 38. In this manner it is possible to actuate rotations of any number of degrees of the cam members 18 and 20 as desired by the designer of the climbing aid. A circumferential groove or tube may be desired to hold the position of the wire 39 as it winds and unwinds on the spindle 27. It is also possible to use a flat spring or coil or string instead of a wire so as to improve the performance or reliability of the trigger mechanism. It may be desirable to wind some extra wire on the trigger cam to improve the wire seating and make tangling of the wire in the cam members less likely or even impossible.

As noted above, it is sometimes desirable to limit the rotation of the cam members with respect to each other. In addition to the fixed stops 21, 23 described above, a floating rotation stop may be introduced to limit the rotation to a rotational angle greater than 360 degrees. Although not illustrated in the drawings, a floating stop may be defined by a stop ring that is free to rotate between large cam member 16 and the adjacent smaller cam member 20. A pin extending from the cam member 20 engages a cooperatively shaped stop surface on the stop ring and rests against a side face of cam member 16 at the point at which rotation is desired to be stopped. As the cams rotate in the opposite relative direction past 360 degrees, the pin on cam member 20 moves through a groove on cam member 16 and then engages the cooperatively shaped surface on cam member 16 so as to rotate the floating stop ring along with its further rotation and permit the rotation. A similar stopping action can be provided by interference on the opposite side face on cam member 16. Hence, a rotation substantially greater than 360 degrees can be provided for. At the same time, limits on the rotation can be enforced to arbitrary levels of strength with the correct selection of materials and design of the cam members, stop ring, and pins used. It will be appreciated that the roles of the large cam member 16 and the small cam member 20 could be reversed and the functioning of the rotation stop would be equivalent for the purposes of the climbing aid.

It will be appreciated that the cam 10 illustrated in FIGS. 1 through 4 may be locked into a "storage position" that allows the cam to assume a smaller profile that is beneficial when the cam is not in use. With reference to FIG. 2, when cam member 16 is in the position shown in dashed lines, trigger 32 may be released while a user holds cam member 16 in the position of the dashed lines. The trigger 32 moves in the direction of arrow B under spring force until the trigger 32 engages outer surface 28 of cam member 16. The spring pressure on the trigger combined with the spring pressure on the cam member 16 essentially locks the cam 10 in the position shown in dashed lines. In this position, the cam 10 is narrower in profile and thus more convenient to transport. A groove or detent may be formed in the outer surface 28 of the cam member 16 in addition to grooves 30 to hold the cam 10 in the storage position.

As has been previously mentioned, even when placed correctly in cracks, cams are subject to movement as the rope slides through webbing attached to the cams. This random movement can cause a cam to "walk" relative to the rock, jeopardizing placement quality and at times resulting in an unsafe placement. It is desirable therefore to make the climbing aid forcefully stay in place in the placement so as to increase security and safety. As an additional embodiment according to the present invention, a mechanism is provided that creates an opposing force that prevents the climbing aid from moving in the crack or placement. Conceptually the climbing aid is constructed as two climbing aids oriented in opposite directions. Since it is desirable to use the cam members in the climbing aid to provide forces in both directions in this case, the cam angles are adjusted as described below.

Figure 5:
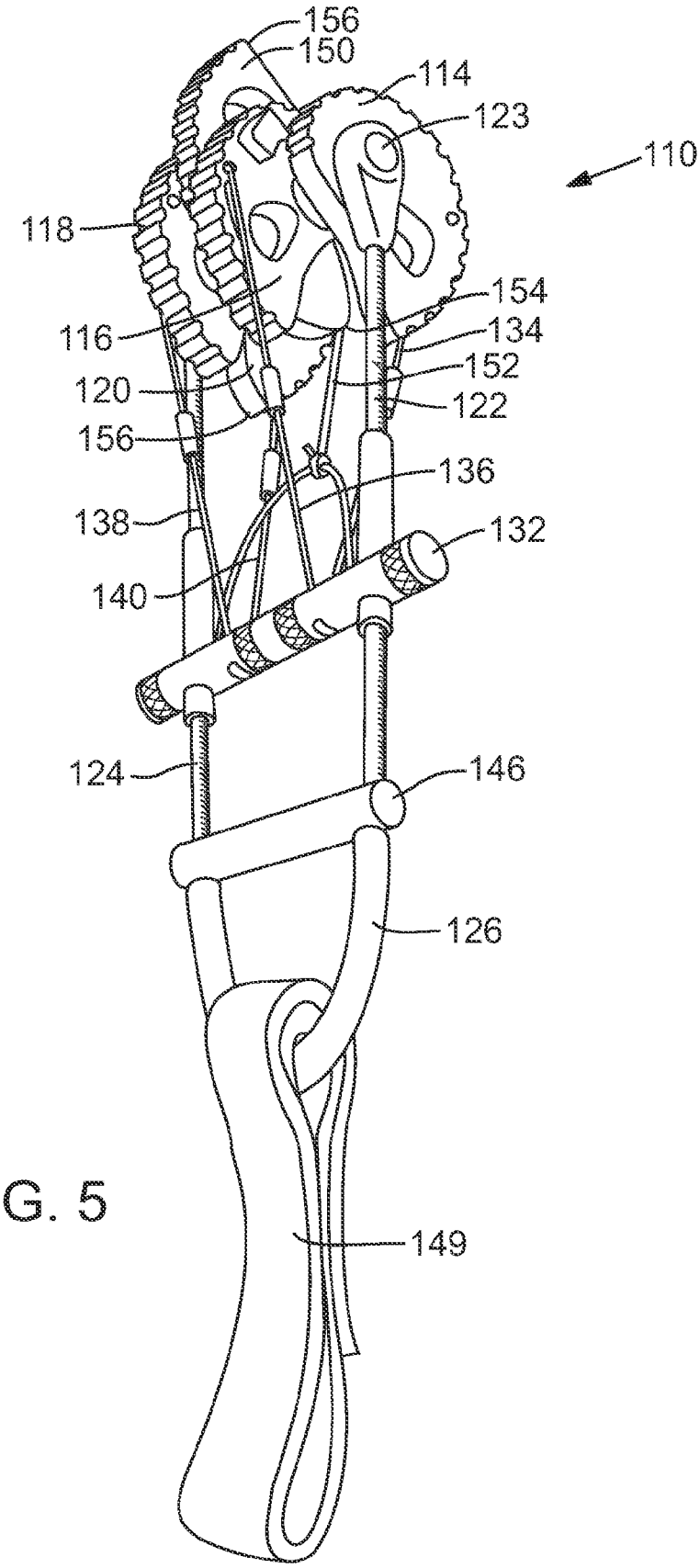
FIG. 5 is a perspective view of an alternative climbing cam device according to the present invention incorporating a separate opposing cam member that provides an opposing force to the other cam members.
Figure 6:
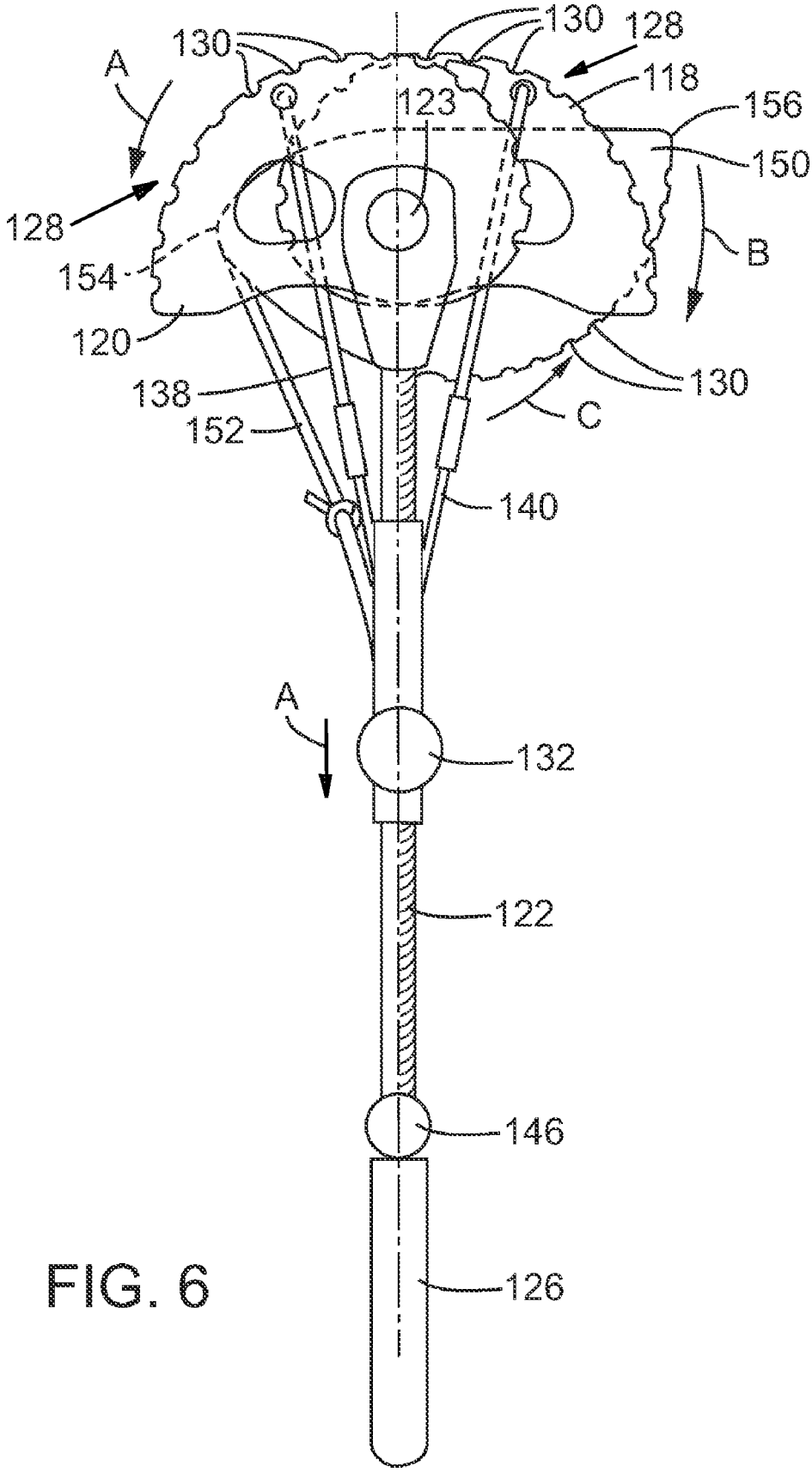
FIG. 6 is a side elevation view of the cam illustrated in FIG. 5 in its open position, showing the opposing cam member in partial phantom lines.

The alternative embodiment just mentioned is illustrated in FIGS. 5 through 8 as the mechanism is used in a conventional cam 10—that is, unlike the cam 10 described above with reference to FIGS. 1 through 4, the cam 10 described herein and shown in FIGS. 5 through 8 utilizes cam members that are symmetrically sized and shaped. It will be readily appreciated, however, that the mechanism described herein may be incorporated into the asymmetric cam 10 of FIGS. 1 through 4. Referring to FIG. 5, cam 110 includes 4 individual cams, labeled 114, 116, 118 and 120, each of which is rotationally mounted on an axle 123 that has opposite ends mounted to the respective end portions of opposite upright arms 122, 124 of a U-shaped member 126. As best illustrated in FIG. 6, each cam 114, 116, 118 and 120 has an eccentrically curved outer surface 128, which in the illustrated embodiment includes a plurality of grooves 130 to increase the holding strength of the device when placed in a crack. Each cam is connected to activation bar 132 by a wire as described above. Wire 134 attaches to cam 114, wire 136 attaches to cam 116, wire 138 attaches to cam 118 and wire 140 attaches to cam 120 (FIG. 5). One end of each wire is connected to the respective cam, and the opposite end is attached to the activation bar (or looped through the activation bar, as shown). Activation bar 132 is slidably mounted on U-shaped member 126 as described above so that the activation bar allows the cams to be activated (i.e., pivotally rotated about the axle) by sliding the activation bar reciprocally along the upright arms 122, 124.

The cam device 10 includes springs spirally wound about the axle and having one end attached to one of the cam members and the opposite end attached to the adjacent cam member, also as described above with reference to FIGS. 1 through 4. The position of the cams shown in FIG. 6 is the resting position, which is also referred to as the "first" or "open" position.

Each cam member 114, 116, 118 and 120 is independently rotationally mounted on the axle 123. However, the two outermost cams 114 and 120 move generally in unison when activation bar 132 is moved, and the two innermost cams 116 and 118 likewise move in unison. Movement of the cam members 114, 116, 118 and 120 is as described above with reference to the embodiment of FIGS. 1 through 4.

A spreader bar 146 is typically attached to the upright arms 122, 124 to maintain the U shape in U-shaped member 126. A sling 149, preferably fabricated from webbing material, is attached to the U-shaped member 126 at the apex of the U.

Returning to FIG. 5, in addition to the four cam members just described, a least one additional cam member 150 is included in which the cam angle is larger than that of the previously described cam members 114 through 120, and its orientation is in the opposite fashion from those other cam members. Cam member 150 is positioned in the middle of the other four cam members—that is, between cam members 116 and 118. It will be appreciated on reference to FIG. 6, that the cam 150 profile expands in the opposite direction of the direction of expansion of the other cam members. Stated in anther way, cam member 150 expands upwardly if the other cam members (114 through 120) expand downwardly, or inwardly if the others expand outwardly, and so forth. In the case that the cam 110 creeps or "walks" inwardly during use, which a normal climbing aid may do, cam 150 will cause the additional "locking" cam members to rotate so as to expand and therefore increase the outward force on the rock. In this manner, by gently wiggling the cam 110, a strong locking action—often over 100 pounds and far greater than the force applied by wiggling during use—may be obtained that prevents further motion of the cam 110. By applying a gentle tension to the trigger 132 and wiggling further, it is possible to release the large outward force as well. While only one opposing cam member 150 is illustrated in FIGS. 5 through 8, it will be appreciated that additional opposing cam members may be incorporated into a cam 110.

With continued reference to FIG. 5, cam member 150 is connected to trigger 132 with a wire or cord 152 that wraps around a first corner 154 of cam member 150. A groove may optionally be provided in the cam member 150 for retaining the wire 152 in place. A spring (not shown) as described above is wound around axle 123 and has a first end connected to cam member 150 and a second end connected to an adjacent cam member to urge cam 150 into the resting position shown in FIG. 6. However, as detailed below, the spring that acts on cam member 150 normally urges the cam member to rotate such that it provides an opposing force to the other cam members. Stop tabs may be provided to arrest rotation of the various cam members, as described above, or other equivalent structure may be used to accomplish the same function.

Turning now to FIG. 6, cam 110 is shown in side view in the resting, open position. The cam is activated—that is, moved from the open position, by moving trigger 132 in the direction of arrow A. When this occurs, cam members 118 and 120 rotate downwardly. In other words, cam member 120 rotates counterclockwise in the direction illustrated by arc A and cam member 118 simultaneously rotates clockwise in the direction illustrated by arc B. Cam member 150 simultaneously rotates in the counterclockwise direction (shown by arc C), but because cam member 150 is oriented oppositely of the other cam members, the rotational leading edge 156 of cam member 150 moves upwardly (in the orientation of the drawing of FIG. 6). The springs described above normally urge these cam members in the opposite directions.

Figure 7:
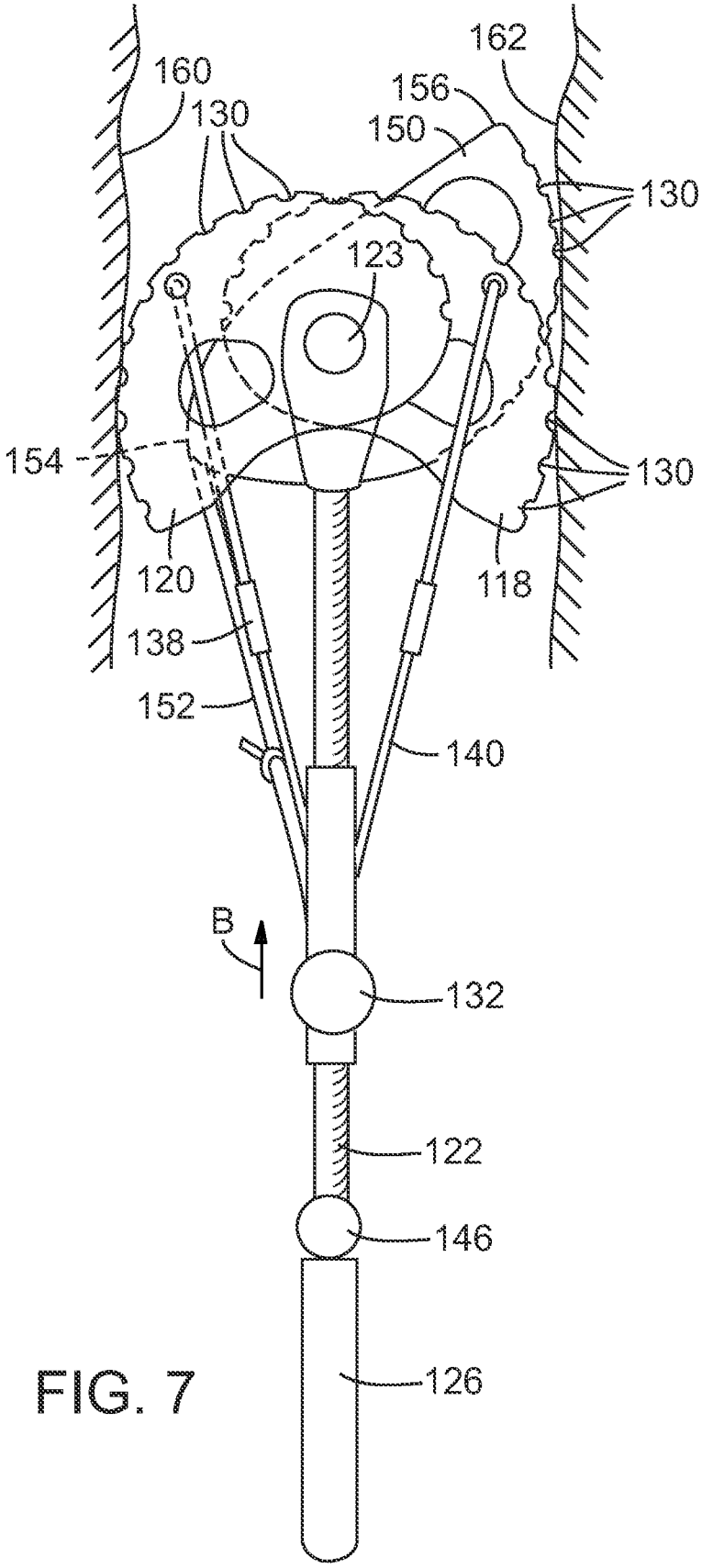
FIG. 7 is a side elevation view of the cam shown in FIG. 6, showing the cam positioned in a crack in a rock and showing the opposing cam member engaging one rock face.

The functional effect of cam member 150 is readily seen and appreciated in FIG. 7, wherein cam 110 is placed in a crack such that cam member 118 is seated against surface 162 and cam member 120 is seated against the opposite side of the crack, surface 160. Cam member 150 is also seated against surface 162. In this position, cam members 118 and 120 are urged by the springs in the upward direction. That is, cam member 118 is urged to rotate in the counterclockwise direction, and cam member 120 is urged toward clockwise rotation. At the same time, cam member 150 is urged downwardly, in the clockwise direction, thereby providing an opposing force to the other cam members 118 and 120. The opposing force supplied by cam member 150 provides a locking mechanism whereby the cam is locked in its placement in the rock. Stated in another way, the combined force applied on the rock surfaces 160 and 162 by cam members 120 and 118, respectively, is generally upwardly directed. The force applied against rock surface 162 from cam member 150 is generally in the opposite direction. These forces, which are in generally opposite directions, lock the cam 110 in place and prevent the cam from walking.

By considering the geometry of the cam 110 it will be seen that the locking action provided by cam member 150 can only be achieved if the cam angle of the cam member 150 is greater than that of the cam members normally included in the climbing aid, such as cam members 114, 116, 118 and 120. If not, an inward or upward motion of the climbing aid (arrow B, FIG. 7), although resulting in an expansion of the cam member 150, would be more than offset by the contraction of the cam members 114 through 120. By having a larger cam angle for cam member 150 relative to the other cam members is it possible to have a net increase in size of the climbing aid and therefore a "locking" action.

Figure 8:
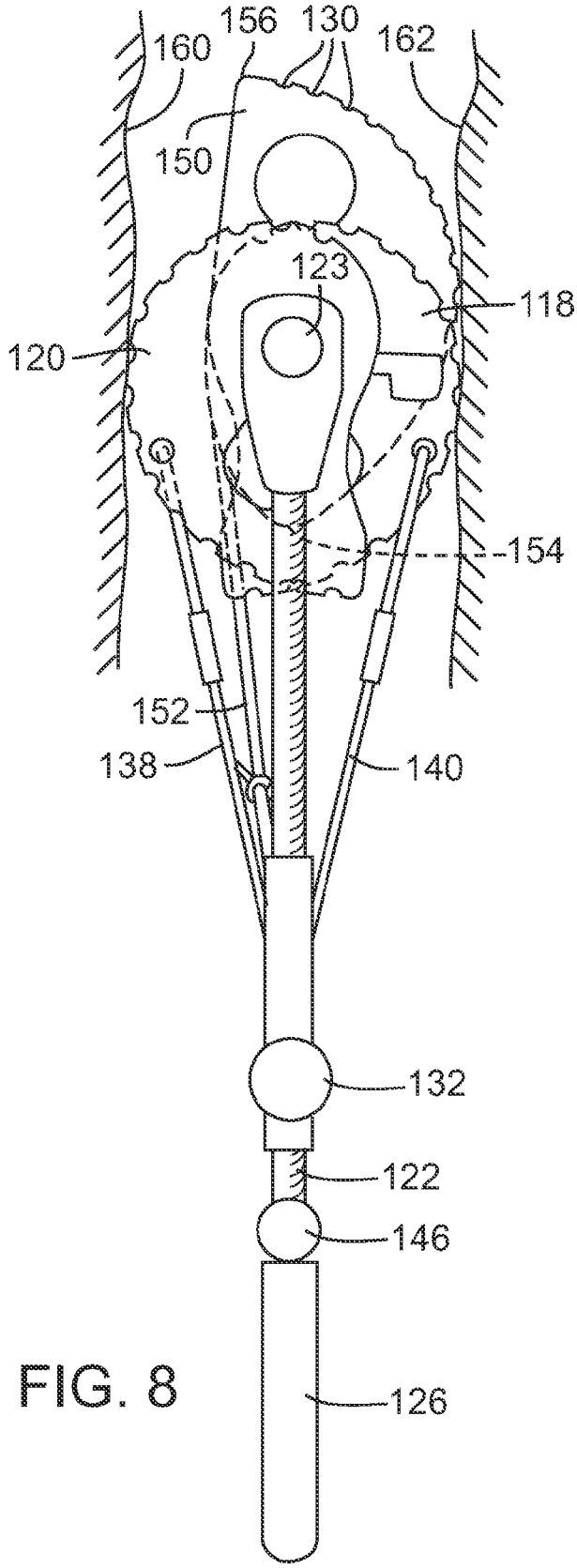
FIG. 8 is a side elevation view of the cam shown in FIG. 7 in a relatively narrower rock crack wherein the cam is shown with the cam members in a nearly fully compressed condition.

FIG. 8 shows cam 110 inserted into a crack that is relatively narrower than the crack shown in FIG. 7, and further illustrates the locking action provided by cam member 150.

A further consideration is applied in the design of the additional cam member in that by choosing a cam angle relatively close to the friction limit on many types of rock, it is possible to make an easy release of the locking action provided by cam member 150. Wiggling of the cam 110, while the additional cam member 150 is near the friction limit makes it possible for the additional cam member 150 to slip free momentarily and with tension on trigger 132, results in a freeing of the locking action. It will be appreciated that when the cam 110 is used to arrest a fall or for direct aid, the additional cam member 150 is not needed or used for support and therefore operating near the friction limit for this cam member is immaterial for the ability of the climbing aid to successfully sustain the load of the fall. Nonetheless, the locking action ensures that the climbing aid remains in the optimal spot in the crack or placement so as to hold the greatest possible force if and when that force is applied.

It will be appreciated that the aforementioned locking mechanism could be included on a climbing aid of either the asymmetric or conventional non-asymmetric type in essentially identical fashion.

While the present invention has been described in terms of a preferred embodiment, it will be appreciated by one of ordinary skill that the spirit and scope of the invention is not limited to those embodiments, but extend to the various modifications and equivalents as defined in the appended claims.

I claim:

1. A climbing cam comprising:

a first cam mounted on an axle;

a second cam mounted on the axle, a third cam and a fourth cam mounted on the axle between the first and second cams;

a fifth cam mounted on the axle between the third and fourth cams;

a trigger connected to: the first and third cams with a first wire; the second and fourth cams with a second wire; and the fifth cam with a third wire.

2. The climbing cam according to claim 1 wherein the trigger is movable between a first position in which the cams are in an expanded state and a second position in which the cams are in a retracted state and is operable to rotate all of the cams, and wherein movement of the trigger from the second position toward the first position causes the first, second and fifth cams to rotate in a first rotational direction and the third and fourth cams to rotate in a second rotational direction opposite the first rotational direction.

3. The climbing cam according to claim 2 wherein when the climbing cam is inserted into a rock crack having opposite sides and the trigger is in the first position, the first and second cams engage the same side of the rock crack and the third, fourth and fifth cams engage the opposite side of the rock crack.

4. The climbing cam according to claim 3 wherein the first, second, third and fourth cams prevent removal of the climbing cam from the crack and the fifth cam prevents the climbing cam from further insertion into the crack.

5. The climbing cam according to claim 2 in which each of the cams has an eccentrically curved outer surface and wherein the fifth cam is mounted on the axle such that its eccentrically curved outer surface is oriented oppositely the eccentrically curved outer surfaces of the first, second, third and fourth cams.

6. The climbing cam according to claim 5 wherein when the climbing cam is inserted into a rock crack having opposite sides and the trigger is in the first position, the first and second cams engage the same side of the rock crack and the third, fourth and fifth cam engages the opposite side of the rock crack.

7. The climbing cam according to claim 6 wherein the first, second, third and fourth cams are configured to prevent removal of the cam from the rock crack, and the fifth cam is configured to prevent insertion of the cam into the rock crack.

8. The climbing cam according to claim 1 wherein each of the cams defines a cam angle and the cam angle of the fifth cam is greater than the cam angle of the other cams.

9. The climbing cam according to claim 1 movement of the trigger from a first position to a second position causes the fifth cam to expand in a first direction and the other cams to expand in a direction that is different from the first direction.

10. A climbing cam having multiple cams movable between a retracted state for insertion into a rock crack, and an expanded state where the multiple cams engage the sides of the rock crack, comprising:

a first pair of cams mounted on an axle and configured for engaging a first side of a rock crack in the expanded state;

a second pair of cams mounted on the axle and configured for engaging a second side of the rock crack in the expanded state;

said first and second pairs of cams configured for preventing removal of said climbing cam from said rock crack in the expanded; and at least one additional cam mounted on the axle and configured for preventing insertion of said climbing cam into said rock crack in the expanded state.

11. The climbing cam according to claim 10 wherein the at least one additional cam defines cam anti-walk means for preventing movement of the climbing cam relative to the rock crack when the cam is inserted into a rock crack and is in the expanded state.

12. The climbing cam according to claim 11 including a trigger connected to and operable to rotate all of the cams, said trigger movable between a first position in which the cams are in the expanded state and a second position in which the cams are in the retracted state, and wherein movement of the trigger from the second position toward the first position causes the first pair of cams and the at least one additional cam to rotate in a first rotational direction and the second pair of cams to rotate in a second rotational direction opposite the first rotational direction.

13. The climbing cam according to claim 12 wherein when the climbing cam is inserted into the rock crack and the trigger is in the first position, the first pair of cams engage a first side of the rock crack, and the second pair of cams and the at least one additional cam engages the opposite side of the rock crack.

14. The climbing cam according to claim 13 wherein the first and second pairs of cams prevent removal of the climbing cam from the crack when the trigger is in the first position and the at least one additional cam prevents the climbing cam from further insertion into the crack when the trigger is in the first position.

15. The climbing cam according to claim 10 wherein each of the cams defines a cam angle and the cam angle of the at least one additional cam is greater than the cam angle of the other cams.

16. In a climbing cam having plural cams rotatably mounted on an axle and movable between a retracted position so that the climbing cam may be inserted into a rock crack and an expanded position wherein at least one of the plural cams engages a first side of the rock crack and at least one of the plural cams engages an opposite side of the rock crack to prevent the climbing cam from being removed from the rock crack, the improvement comprising, a locking cam mounted on the axle and movable between a retracted position so that the climbing cam may be inserted into a rock crack and an expanded position wherein the locking cam engages one side of the rock crack to lock the climbing cam in the rock crack to minimize movement of the climbing cam, wherein said locking cam expands in a direction different from all other cams.

17. The climbing cam according to claim 16 wherein when the climbing cam is inserted into a rock crack and is in the expanded position, the locking cam bears against one side of the rock crack and thereby prevents the climbing cam from being further inserted into the rock crack, and the other cams bear against the respective first and opposite sides of the rock crack and thereby prevent the climbing cam from being removed from the rock crack.

18. The climbing cam according to claim 16 further including a trigger slidably mounted on a frame for movement between a first position in which the climbing cam is in the retracted position and a second position in which the climbing cam is in the expanded position, a first wire connecting the trigger to the at least one cam that engages the first side of the rock crack, a second wire connecting the trigger to the at least one cam that engages the opposite side of the rock crack, and a third wire connecting the trigger to the locking cam.

19. The climbing cam according to claim 18 wherein movement of the trigger from the first position to the second position causes the locking cam to expand in a first direction and the other cams to expand in a second direction that is different from the first direction.

20. The climbing cam according to clam 19 in which every cam defines a cam angle, and wherein the cam angle of the locking cam is greater than the cam angle of the other cams.

* * * * *